United States Patent [19]

Das et al.

[11] Patent Number: 4,570,746

[45] Date of Patent: Feb. 18, 1986

[54] WIND/BREATH SCREEN FOR A MICROPHONE

[75] Inventors: Subrata K. Das, Granite Springs; Norman R. Dixon, Katonah, both of N.Y.; Robert F. Gluck, Bristol, Vt.

[73] Assignee: International Business Machines Corporation, Armonk, N.Y.

[21] Appl. No.: 509,824

[22] Filed: Jun. 30, 1983

[51] Int. Cl.[4] ..... F01N 7/00

[52] U.S. Cl. ..... 181/242; 179/188

[58] Field of Search ..... 181/242, DIG. 1, 30, 181/295; 179/184, 187, 188, 178

[56] References Cited

U.S. PATENT DOCUMENTS

| | | | |
|---|---|---|---|
| 2,346,394 | 4/1944 | Rettinger | 179/188 |
| 2,520,706 | 8/1950 | Anderson et al. . | |
| 3,154,171 | 10/1964 | Knutson et al. | 181/242 |

*Primary Examiner*—L. T. Hix
*Assistant Examiner*—Brian W. Brown
*Attorney, Agent, or Firm*—Yen S. Yee; Marc A. Block

[57] ABSTRACT

An effective wind/breath screen for a microphone is described. The wind/breath screen includes a rigid perforated structure for enclosing the microphone. The microphone being physically isolated from the rigid perforated structure by a surrounding pad of air therebetween. A porous layer is utilized to enclose the rigid perforated structure thereby creating a pad of dead air between the microphone and the porous layer, whereby the speech signal reaches the microphone without substantial attenuation, and the wind/breath noise is suppressed. The present wind screen for a microphone is optimized for, and is particularly effective for voice data entry applications.

6 Claims, 3 Drawing Figures

WIND/BREATH SCREEN FOR A MICROPHONE

DESCRIPTION

1. Technical Field

This invention relates generally to a wind/breath screen for a microphone, and more particularly to a wind/breath screen for a microphone which is suitable as an input device for voice data entry applications.

2. Background Art

In many applications where there is a need for microphone capture of speech or other acoustic signals, a potential contaminant of signal quality is breath and/or wind turbulence. In voice data entry applications, such as automatic speech recognition, utterance detection, speaker verification/recognition, and speech encoding, transmission, decoding applications, this contaminant often leads to poor system performance. Heretofore, two methods have been used to avoid or alleviate this problem, i.e., first, the physical separation of the talker and the microphone, and secondly the utilization of a wind/breath screen (hereinafter referred to as the "wind screen"). The former has met with limited success and is useful only in very quiet environments where there is no air turbulence. Conventional wind screens are nothing more than muffs of porous material, usually foam, inside which a microphone sits.

The effectiveness of such conventional wind screens depends upon the wall thickness and the resilience of the porous material used. In such conventional wind screens, the porous material is in direct contact with the entire exterior surface of the microphone. The mechanical energy resulting from air turbulence on the outside of the porous muff is conducted directly to the microphone by the porous material itself. The acoustic damping level is dependent upon the wall thickness, i.e., the distance the acoustic signal has to travel before it reaches the microphone. If this distance is great enough to suitably attenuate noise, it will also attenuate the speech signal to an unacceptable degree. As a result, conventional wind screens are only of marginal value in filtering noise from air turbulence.

Some early sound pickup apparatus are provided with wind screens. For instance, U.S. Pat. No. 1,987,413 issued to H. F. Olson discloses a wind screen for a microphone including the use of a perforated metallic shield covered by a thin silk screen fabric. Also, U.S. Pat. No. 2,346,394 issued to M. Rettinger is directed to an improved wind screen for a microphone, comprising a first and second perforated metallic shield covered by thin silk screen fabrics, for further reducing the effects of strong winds.

Still other earlier microphones are equipped with improvements to reduce the wind effects or turbulence within the microphone itself, thereby enhancing the signal to noise ratio. For instance, in U.S. Pat. No. 2,536,261 the high acoustical impedance of relatively small openings providing an effective speed input area of reduced size for a microphone is utilized to reduce wind effects or turbulence. Also, U.K. Pat. No. 855,972 is directed to a spherical wind-shield for a microphone comprised of two layers of mesh and central lining, and the microphone is situated in substantially the center of the spherical wind-shield. Similarly, U.K. Pat. No. 1,121,718 discloses a microphone suspended in a hollow casing by two resilient members. A wind and breath shield comprises an inner fine gauze and an outer coarse gauze is also provided.

Some recent microphone devices are directed to the problem of detecting a sound wave when the microphone is placed in a sound field in which the sound waves coexist with a flow of air. For instance, U.K. Pat. No. 1,245,803 is directed to a microphone device comprising a hollow, elongated, streamlined cover member closed at one end and made of porous material, the cover member having a circular cross-section and defining a cavity, and a microphone disposed in such a manner that the diaphragm of the microphone is exposed in the cavity. Likewise, U.K. Pat. No. 1,159,443 discloses a microphone having protection against shock and wind. According to the disclosure, microphones are surrounded by polyester foam, and then enclosed by a perforated structure. Additional cavities are disposed adjacent to the microphone openings so as to improve the acoustic coupling between the foam and the microphones.

Yet a water-proof protector for a microphone is described in D.D.R. (East German) Pat. No. DL-141-746. According to the disclosure, the protector consists of a pliable basic component with appropriate apertures. A thin, waterproof elastic membrane covers this basic component. The letter can be laminated. It can consist of a porous material.

DISCLOSURE OF INVENTION

It is a principal object of the present invention to provide an improved wind screen for a microphone for voice data entry applications.

It is another principal object of the present invention to provide a wind screen for a microphone for reducing substantially the wind and or breath noise.

It is another object of the present invention to provide a wind screen for a microphone for reducing substantially the wind and or breath noise, and without attenuating the speech signal.

It is also an object of the present invention to provide a wind screen for a microphone that is both physically small and light to facilitate ease of use.

It is yet another object of the present invention to provide a close-talking microphone for speech processing by machines.

These and other objectives of the present invention can be achieved by way of wind/breath screen, herein referred to as the "wind screen", for a microphone for suppressing an air turbulence noise without attenuating a speech signal, comprising: a rigid perforated structure for enclosing said microphone in substantially the center of said perforated structure; said microphone being physically isolated from said rigid perforated structure by a surrounding pad of air therebetween; a porous material enclosing said rigid perforated structure thereby creating a pad of dead air between said microphone and said porous material, whereby said speech signal reaches said microphone without substantial attenuation, and said air turbulence noise is suppressed.

Alternatively other objects of the present invention can be achieved by way of a microphone apparatus for suppressing an air turbulence noise without attenuating a speech signal, comprising: a microphone element for receiving the speech signal; a rigid perforated structure for enclosing said microphone element in substantially the center of said perforated structure; said microphone element being physically isolated from said rigid perforated structure by a surrounding pad of air therebetween; a porous material enclosing said rigid perforated structure thereby creating a pad of dead air between said microphone element and said porous material, whereby said speech signal reaches said microphone element without substantial attenuation, and said air turbulence noise is suppressed.

The nature, principle and utility of the present invention will be better understood from the hereinafter detailed description of the invention when read in conjunction with the accompanying drawings.

BRIEF DESCRIPTION OF DRAWINGS

Details of the invention will be described in connection with the accompanying drawings, in which.

DESCRIPTION OF THE PREFERRED EMBODIMENT

Figure 1:
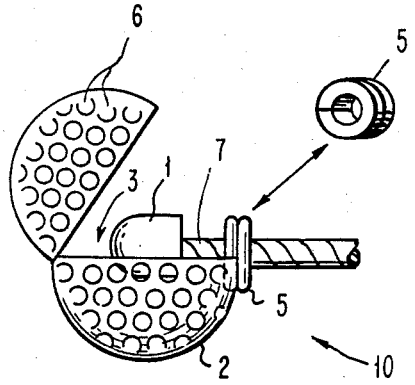
FIG. 1 is a side view of part of the wind screen according to the present invention showing the rigid perforated structure 2 enclosing the microphone 1.
Figure 2:
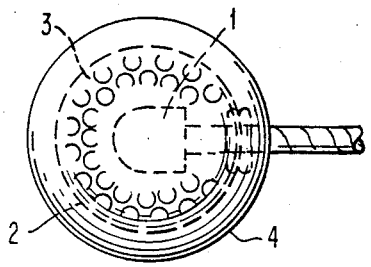
FIG. 2 is an illustration of the wind screen shown in FIG. 1 showing the porous material 4 enclosing the rigid perforated structure 2.

Referring to FIGS. 1 and 2, a wind screen for a microphone according to the present invention includes a rigid perforated structure 2 enclosing the microphone 1, which is located in substantially the center of the perforated structure 2, and a porous material 4 enclosing the rigid perforated structure 2.

The rigid structure 2 can be provided with a array of periodic perforations 6, and can be made of a lightweight material such as aluminium, or preferably plastic. Such a rigid perforated structure 2 is preferably formed by two semi-spheres having a diameter of about 1.25 inches, and are hinged together at one point of the two semi-spheres (FIG. 1).

According to the present invention, the advantages of the present wind screen are achieved by having the microphone 1 physically isolated from the rigid perforated structure 2 by a surrounding pad of air 3. The enclosing porous material 4 forms a layer on the exterior surface of the rigid perforated sphere 2 thereby creating a pad of dead air 3 between the microphone 1 and the porous material 4. The term "pad of dead air" as used here and hereinafter refers to an isolated air space which is neither continuous in the external ambient environment nor with the isolated component, i.e., the microphone 1. In the present invention, the pad of dead air 3 is protected from distortion and is substantially isolated from the external ambient air by the perforated rigid plastic sphere 2 covered by a porous layer 4.

The microphone 1 is supported by, and connected to the exterior by way of a connecting attachment 7 through the rigid perforated sphere 2. The connecting attachment 7, which can be the microphone electrical connecting cables, could be isolated from the rigid perforated sphere 2 by resilient means such as rubber grommet 5. Rubber grommet 5 being straddled between the interior and the exterior surfaces of the rigid perforated sphere also helps to preserve the noise isolation characteristics provided by the pad of dead air 3.

The enclosing porous layer 4 can be a number of porous sponge-like materials such as latex foam. The porous layer 4 should have a layer thickness of about ¼ inch to permit the passage of the speech signal without an unacceptable attenuation while providing a needed attenuation of airborne acoustic energy resulting from turbulence as a result of the wind or breath. Accordingly, the construction of the wind screen is such that the overall dimensions of the wind screen is small and light thereby facilitating the user's handling of the microphone 1.

Figure 3:
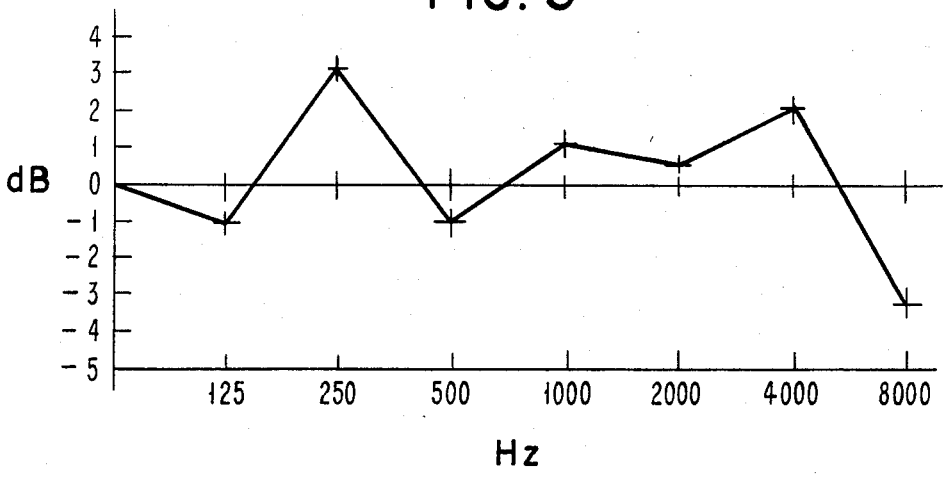
FIG. 3 is a frequency response characteristics curve of a microphone equipped with a wind screen according to the present invention, showing minimal frequency response degradation.

From experimental data gathered, the pad of dead air 3 spaced therebetween the microphone 1 and the porous layer 4 provides one of the simplest and most effective acoustic isolation against wind and/or breath noises. More specifically, with the microphone 1 having no wind screen attached serving as a zero reference level, a conventional porous muff type of wind screen attenuated air turbulence by 12 dB while the wind screen according the teaching of the present invention attenuated 24 dB. This represents a substantial improvement over the conventional wind screen. Referring to FIG. 3, experimental data also demonstrated that the wind screen according to the present invention has no appreciable impacts on the overall frequency response of the microphone 1. The results showed that over the frequency spectrum of interest, i.e. from about 125 Hz to about 8000 Hz. for voice data entry applications, the degradation on frequency response is minimal. Microphones having wind screens according to the teaching of the present invention have been tested in voice data entry systems and have shown significant overall system improvements.

From the preceding detailed description of applicants' invention, it is seen that microphones equipped with wind/breath screens according to the teaching of the present invention have advantages heretofore not been possible to achieve. In addition to the variations and modifications to applicants' disclosed apparatus which have been suggested, many other variations and modifications will be apparent to those skilled in this art, and accordingly, the scope of applicants' invention is not to be construed to be limited to the particular embodiments shown or suggested.

We claim:

1. A wind screen for use with a microphone element, the wind screen comprising:

a rigid perforated structure dimensioned to enclose the microphone element;

a porous material forming a layer on and surrounding said rigid perforated structure;

said layer on and surrounding said perforated structure being dimensioned to create a pad of dead air therein which, when the microphone element is enclosed, extends between said perforated structure with the porous layer thereon and the microphone element to isolate the microphone element from air turbulence outside said porous layer without substantially attenuating a speech signal directed to the microphone element from outside said porous layer;

wherein said microphone is supported by a connecting attachment through said rigid perforated structure, said connecting attachment being isolated from said rigid perforated structure by resilient means;

wherein said rigid perforated structure is a perforated plastic sphere; and wherein said porous material is latex foam.

2. A wind screen for a microphone as set forth in claim 1, wherein said resilient means is a rubber grommet.

3. A microphone apparatus for suppressing air turbulence noise without attenuating a speech signal, comprising:

a microphone element for receiving said speech signal;

a rigid perforated structure for enclosing said microphone element in substantially the center of said perforated structure;

said microphone element being physically isolated from said rigid perforated structure by a pad of air therebetween the pad of air surrounding said microphone;

a porous material enclosing said rigid perforated structure thereby creating a pad of dead air between said microphone element and said porous material;

whereby said speech signal reaches said microphone element without substantial attenuation, and said air turbulence noise is suppressed by said porous material enclosing said rigid perforated structure and the pad of dead air;

wherein said microphone element is supported by a connecting attachment through said rigid perforated structure, said connecting attachment being isolated from said rigid perforated structure by resilient means;

wherein said rigid perforated structure is a perforated plastic sphere; and wherein said porous material is latex foam.

4. A microphone apparatus as set forth in claim 3, wherein said resilient means is a rubber grommet.

5. In combination with a microphone, a wind screen which permits a speech signal to reach the microphone without substantial attenuation while air turbulence noise is suppressed, the wind screen comprising:

a single rigid perforated structure for surrounding the microphone; and a layer of porous material formed on the exterior surface of said single rigid perforated structure;

said rigid perforated structure being spaced from the microphone to form a pad of air extending between the microphone and said single rigid perforated structure with the porous layer thereon when said perforated structure surrounds the microphone;

said layer of porous material being characterized in that it, together with the perforated structure, makes the pad of air a pad of dead air surrounding the microphone;

wherein said layer of porous material comprises foam.

6. A wind screen for use with a microphone, as in claim 5, further comprising:

means for resiliently coupling the microphone through said rigid perforated structure, the microphone being isolated from the rigid perforated structure by said coupling means.

* * * * *